United States Patent [19]

Watanabe et al.

[11] Patent Number: 4,485,139

[45] Date of Patent: Nov. 27, 1984

[54] HEAT-SENSITIVE RECORDING PAPER

[75] Inventors: Shojiro Watanabe; Tomizo Namiki; Fumiaki Shinozaki, all of Shizuoka, Japan

[73] Assignee: Fuji Photo Film Co., Ltd., Kanagawa, Japan

[21] Appl. No.: 487,621

[22] Filed: Apr. 22, 1983

[30] Foreign Application Priority Data

Apr. 28, 1982 [JP] Japan ..... 57-72201

[51] Int. Cl.[3] ..... B41M 5/16; B41M 5/18; B41M 5/22

[52] U.S. Cl. ..... 428/219; 428/537.1; 428/913; 428/411.1; 346/227; 430/338; 430/340; 430/961; 430/531

[58] Field of Search ..... 430/338, 340, 961, 531; 428/913, 411, 53 T, 219; 282/27.5

[56] References Cited

U.S. PATENT DOCUMENTS

| | | | |
|---|---|---|---|
| 2,663,654 | 12/1953 | Miller et al. | 430/340 |
| 4,245,032 | 1/1981 | Fanselow | 430/961 |
| 4,291,902 | 9/1981 | Burri | 428/913 |
| 4,349,218 | 9/1982 | Garner et al. | 428/913 |
| 4,370,370 | 1/1983 | Iwata et al. | 428/913 |
| 4,388,362 | 6/1983 | Iwata, et al. | 428/913 |

*Primary Examiner*—Won H. Louie

*Attorney, Agent, or Firm*—Sughrue, Mion, Zinn, Macpeak & Seas

[57] ABSTRACT

A heat-sensitive recording paper is disclosed. The paper is comprised of a support base having a heat-sensitive color forming layer coated thereon. The color forming layer contains color forming components comprising an almost colorless electron donating dye and an organic acid capable of forming color when contacted with the dye. The color forming layer is coated with a coating layer containing polyvinyl alcohol and boric acid. Due to the existence of the coating layer the recording paper has substantial resistance to decrease the recording density and occur the fog by various chemicals and oils.

7 Claims, No Drawings

HEAT-SENSITIVE RECORDING PAPER

FIELD OF THE INVENTION

This invention relates to a heat-sensitive recording paper and, more particularly, to a heat-sensitive recording paper which does not undergo disappearance of recorded color image and background fogging due to various chemicals and oils.

BACKGROUND OF THE INVENTION

Heat-sensitive recording papers provide images by utilizing physical or chemical change of a substance caused by heat energy. A considerable number of such processes have been studied.

Recently, heat-sensitive recording papers have come into use as recording papers for recording outputs from facsimile or computers utilizing their merits or primary coloration and the lack of a need for a developing step. An example of such recording papers is referred to a dye-type, and is disclosed in Japanese Patent Publication Nos. 4160/68 and 14039/70 (U.S. Pat. Nos. 2,663,654 and 2,967,785), and Japanese Patent Application (OPI) No. 27253/80 (the term "OPI" as used herein refers to a "published unexamined Japanese patent application") (corresponding to U.S. Pat. No. 4,283,458).

In general, the use of heat-sensitive recording paper as a recording paper is desirable because the recording devices can be made lighter in weight and smaller in size. Accordingly, such paper has rapidly come into use. On the other hand, the heat-sensitive recording paper is not desirable when chemicals or oils are deposited thereon, images recorded thereon disappear or fogs are formed. These defects are serious from the practical point of view; thus promoting efforts to eliminate such defects.

Japanese Utility Model Laid-Open No. 125354/81 proposes a means of improving resistance against color disappearance with a plasticizer by providing a coating layer of a water-soluble high polymer on a heat-sensitive color forming layer for preventing permeation of the plasticizer. However, this process is insufficient for imparting resistance against various chemicals or oils.

Japanese Patent Application (OPI) No. 146794/81 proposes a means of imparting water resistance as well as resistance against color disappearance with a plasticizer by providing a coating layer containing a hydrophobic high polymer and/or water resistance-imparting agent in addition to the water-soluble high polymer. According to this proposal, an intermolecular cross-linking agent such as formalin, glyoxal, or melamine resin is used as a water resistance-imparting agent. When a coating layer of intermolecularly cross-linked water-soluble high polymer is provided, resistance against various chemicals and oils is improved to some extent as compared to that wherein only a coating layer of water-soluble high polymer is provided, but the resistance is still insufficient.

SUMMARY OF THE INVENTION

An object of the present invention is to provide a heat-sensitive recording paper having sufficient resistance against various chemicals and oils.

This object of the present invention has been successfully attained by a heat-sensitive recording paper having a coating layer containing polyvinyl alcohol and boric acid provided on a heat-sensitive color forming layer containing as color forming components an almost colorless electron donating dye and an organic acid capable of forming color when in contact with said dye.

DETAILED DESCRIPTION OF THE INVENTION

Boric acid is known to form a monodiol type chemical bond with polyvinyl alcohol, and is essentially different from the intermolecular cross-linking agents such as formalin, glyoxal, melamine resin, etc.

The degree of saponification of the polyvinyl alcohol used in the coating layer of the present invention is 80 to 100 mol%, preferably 90 to 100 mol%, more preferably 98 to 100 mol%. If the degree of saponification is less than 80 mol%, there results insufficient resistance against various chemicals and oils. The polyvinyl alcohol used in the present invention has a molecular weight of 500 to 1,700, preferably 900 to 1,700, and the polyvinyl alcohol is preferably applied in a coating amount of 2 to 4 g/m$^2$.

Boric acid is used in an amount of 1 to 20 parts by weight, preferably 3 to 12 parts by weight, per 100 parts by weight of polyvinyl alcohol. If the amount of boric acid is less than 1 part by weight, there results an insufficient resistance against various chemicals and oils, and if more than 20 parts by weight, the coating is impossible because of gelation of the coating solution.

A coating layer solution comprising polyvinyl alcohol and boric acid in the above-described proportion is prepared and coated on a heat-sensitive color forming layer to be described hereinafter. The coating is then dried to form the intended coating layer.

The heat-sensitive color forming layer of the present invention is described below.

Typical examples of the electron donating colorless dye (color former) used in the present invention include (1) triarylmethane compounds, (2) diphenylmethane compounds, (3) xanthene compounds, (4) thiazine compounds, and (5) spiropyran compounds, and specific examples thereof are described in U.S. Pat. No. 4,283,458. The color former is preferably used in an amount of 0.3 to 1 g/m$^2$. Specific examples of triarylmethane compounds include 3,3-bis(p-dimethylaminophenyl)-6-dimethylaminophthalide (namely, Crystal Violet lactone), 3,3-bis(p-dimethylaminophenyl)phthalide, 3-(p-dimethylaminophenyl)-3-(1,2-dimethylindol-3-yl)phthalide, 3-(p-dimethylaminophenyl)-3-(2-methylindol-3-yl)phthalide, 3-(p-dimethylaminophenyl)-3-(2-phenylindol-3-yl)phthalide, 3,3-bis(1,2-dimethylindol-3-yl)-5-dimethylaminophthalide, 3,3-bis(1,2-dimethylindol-3-yl)-6-dimethylaminophthalide, 3,3-bis(9-ethylcarbazol-3-yl)-5-dimethylaminophthalide, 3,3-bis(2-phenylindol-3-yl)-5-dimethylaminophthalide and 3-p-dimethylaminophenyl-3-(1-methylpyrrol-2-yl)-6-dimethylaminophthalide. Specific examples of diphenylmethane compounds include 4,4'-bisdimethylaminobenzhydrin benzyl ether, N-halophenyl leuco Auramine and N-2,4,5-trichlorophenyl leuco Auramine. Specific examples of xanthene compounds include Rhodamine B anilino lactam, Rhodamine (p-nitroanilino)lactam, Rhodamine B (p-chloroanilino)lactam, 7-dimethylamino-2-methoxyfluoran, 7-diethylamino-2-methoxyfluoran, 7-diethylamino-3-methoxyfluoran, 7-diethylamino-3-chlorofluoran, 7-diethylamino-3-chloro-2-methylfluoran, 7-diethylamino-2,3-dimethylfluoran, 7-diethylamino(3-acetylmethylamino)fluoran, 7-diethylamino(3-methylamino)fluoran, 3,7-diethylaminofluoran, 7-diethylamino-3-

(dibenzylamino)fluoran, 7-diethylamino-3-(methylbenzylamino)fluoran, 7-diethylamino-3-(chloroethylmethylamino)fluoran and 7-diethylamino-3-(diethylamino)fluoran. Specific examples of thiazine compounds include benzoyl leuco Methylene Blue and p-nitrobenzyl leuco Methylene Blue. Specific examples of spiropyran compounds include 3-methyl-spirodinaphthopyran, 3-ethyl-spiro-dinaphthopyran, 3,3'-dichloro-spiro-dinaphthopyran, 3-benzyl-spiro-dinaphthopyran, 3-methyl-naphtho-(3-methoxybenzo)spiropyran and 3-propyl-spiro-dibenzopyran. These compounds may be used alone or as a mixture.

Above all, xanthene type color former, many of which form less fog and provide high coloration density, are preferable.

Preferred organic acids used in the present invention include phenol derivatives and aromatic carboxylic acid derivatives, with bisphenols being particularly preferable. The organic acids are preferably used in an amount of 2 to 5 parts by weight per 1 part by weight of the color former.

Specific examples of the phenol derivatives include p-octylphenol, p-tert-butylphenol, p-phenylphenol, 1,1-bis(p-hydroxyphenyl)propane, 2,2-bis(p-hydroxyphenyl)propane, 1,1-bis(p-hydroxyphenyl)pentane, 1,1-bis(p-hydroxyphenyl)hexane, 2,2bis(p-hydroxyphenyl)-hexane, 1,1-bis(p-hydroxyphenyl)-2-ethyl-hexane, 2,2-bis(4-hydroxy-3,5-dichlorophenyl)propane, etc.

Useful aromatic carboxylic acid derivatives include benzyl p-hydroxybenzoate, ethyl p-hydroxybenzoate, butyl p-hydroxybenzoate, 3,5-di-tert-butylsalicylic acid, 3,5-di-$\alpha$-methylbenzylsalicylic acid and polyvalent metal salts of these carboxylic acids.

Upon preparing a coating solution for producing heat-sensitive recording paper, it is necessary to disperse the above-described materials for producing heat-sensitive recording paper using water as a dispersion medium. Accordingly, the use of a water-soluble high polymer such as polyvinyl alcohol, hydroxyethyl cellulose or starch derivative is preferable. Dispersion of the material for producing heat-sensitive recording material using the dispersion medium is conducted by adding 10 to 50 wt% (based on the weight of the dispersion solution) of an electron donating dye or an organic acid to a dispersion medium generally containing 1 to 10 wt% (based on the weight of the dispersion medium), preferably 2 to 5 wt%, of a water-soluble high polymer, and using a dispersing machine such as a ball mill, sand mill, attritor, colloid mill, etc.

To a mixture of the above-described dispersions are added, if necessary, an oil-absorbing pigment, wax, metallic soap, etc., to prepare a coating solution for producing heat-sensitive recording paper. The resulting solution is coated on a support such as paper or plastic to obtain the intended heat-sensitive color forming layer.

The oil-absorbing pigment is selected from among kaolin, calcined kaolin, talc, pyrophyllite, diatomaceous earth, calcium carbonate, aluminum hydroxide, magnesium hydroxide, magnesium carbonate, titanium oxide, barium carbonate, urea-formalin filler, cellulose filler, etc.

Examples of useful waxes include paraffin wax, carnauba wax, microcrystalline wax, polyethylene wax, higher fatty acid amides (e.g., stearic acid amide, ethylenebisstearoamide, etc.), and higher fatty acid esters.

Useful metallic soaps include polyvalent metal salts of higher fatty acids such as zinc stearate, aluminum stearate, calcium stearate and zinc oleate.

The present invention will now be described in more detail by the following examples which, however, are not to be construed as limiting the present invention in any way.

EXAMPLE 1

20 g of 3-diethylamino-6-chloro-7-($\beta$-ethoxyethyl-)aminofluoran was dispersed in 100 g of a 10% aqueous solution of polyvinyl alcohol (saponification degree: 98%; polymerization degree: 500) in a 300-ml ball mill for about 24 hours to obtain dispersion (A). Similarly, 10 g of 2,2-bis(4-hydroxyphenyl)propane and 10 g of stearic acid amide were dispersed in 100 g of a 10% polyvinyl alcohol aqueous solution in a 300-ml ball mill for about 24 hours to obtain dispersion (B).

The dispersion (A) and the dispersion (B) were mixed with each other in a weight ratio of 3:20, and 500 g of calcium carbonate fine powder was added to 200 g of the resulting mixture and well dispersed to prepare a coating solution for forming a heat-sensitive color forming layer.

This coating solution was coated on a base paper of 50 g/m$^2$ in basis weight in a coating amount of 6 g/m$^2$ by air-knife coating, and dried at 50° C. for 2 minutes to form a heat-sensitive color forming layer.

On the thus-formed heat-sensitive color forming layer was coated a coating solution for forming a coating layer having the following formulation in a coating amount of 3 g/m$^3$, then dried at 50° C. for 2 minutes to form a coating layer. Thus, a heat-sensitive recording paper of the present invention was obtained.

| Coating Solution for Forming Coating Layer: | parts by weight |
|---|---|
| 5% Polyvinyl alcohol (saponification degree: 98%; polymerization degree: 1,700) aqueous solution | 100 |
| 3% Boric acid aqueous solution | 10 |

COMPARATIVE EXAMPLE 1

In the same manner as in Example 1 except for not providing the coating layer, a comparative heat-sensitive recording paper was obtained.

COMPARATIVE EXAMPLE 2

In the same manner as in Example 1 except for providing the coating layer by applying the following coating solution, another comparative heat-sensitive recording paper was obtained.

| Coating Solution for Providing Coating Layer: | parts by weight |
|---|---|
| 5% Polyvinyl alcohol (saponification degree: 98%; polymerization degree: 1,700) aqueous solution | 100 |
| 30% Melamine resin aqueous solution | 3 |

Comparing Tests

Tests for comparing the heat-sensitive recording paper obtained in Example 1 with those obtained in Comparative Examples 1 and 2 were conducted as follows.

(1) Fogging and color forming properties:

Recording was carried out by providing energy in an amount of 2 ms/dot and 50 mJ/m$^2$ to the recording element in a density of 5 dots/mm in main scanning and 6 dots/mm in sub-scanning. The fog (density of background before conducting recording procedure) and the density of the colored product after recording (initial density) were measured by means of a Macbeth Model RD-514 reflection densitometer (using a visual filter).

(2) Tests on resistance against various chemicals and oils:

Various chemicals and oils were individually applied to the colored product in a thickness of about 0.5 μm. The product was then left for 24 hours in an atmosphere of 25° C. and 65% RH. The fog (background density) and the density of the colored product were then measured.

The results of the comparing tests are shown in Table 1.

It is seen from Table 1 that, as compared to the comparative heat-sensitive recording papers, the heat-sensitive recording paper of the present invention undergoes less color disappearance of the colored product due to the effects of chemicals and oils and has excellent fogging resistance.

TABLE 1

| | | | Resistance against Chemicals and Oils | | | | | | | |
|---|---|---|---|---|---|---|---|---|---|---|
| | Initial | | Ethanol | | Di-n-butyl Phthalate | | Diethylene Glycol Monomethyl Ether | | Castor Oil | |
| Run No. | Fog | Density of Color Image | Fog | Density of Color Image | Fog | Density of Color Image | Fog | Density of Color Image | Fog | Density of Color Image |
| Heat-sensitive recording paper obtained in Example 1 | 0.06 | 1.26 | 0.07 | 1.24 | 0.06 | 1.15 | 0.07 | 1.25 | 0.07 | 1.20 |
| Heat-sensitive recording paper obtained in Comparative Example 1 | 0.06 | 1.26 | 0.85 | 1.20 | 0.06 | 0.10 | 0.69 | 1.20 | 0.16 | 0.31 |
| Heat-sensitive recording paper obtained in Comparative Example 2 | 0.06 | 1.24 | 0.55 | 1.21 | 0.06 | 0.51 | 0.44 | 1.22 | 0.16 | 0.77 |

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper, comprising:

(A) a support base having positioned thereon;

(B) a heat-sensitive color forming layer containing, as color forming components, (i) an almost colorless electron donating dye and (ii) an organic acid capable of forming color when contacted with the dye; and (C) a coating layer positioned on the heat-sensitive color forming layer, wherein the coating layer comprises polyvinyl alcohol and boric acid; wherein the degree of saponification of the polyvinyl alcohol is 80 to 100 mol% and wherein the boric acid is present in an amount of 1 to 20 parts by weight per 100 parts by weight of the polyvinyl alcohol.

2. A heat-sensitive recording paper as claimed in claim 1, wherein the degree of saponification of the polyvinyl alcohol is 90 to 100 mol%.

3. A heat-sensitive recording paper as claimed in claim 2, wherein the degree of saponification of the polyvinyl alcohol is 98 to 100 mol%.

4. A heat-sensitive recording paper as claimed in claim 1, wherein the molecular weight of the polyvinyl alcohol is 500 to 1,700.

5. A heat-sensitive recording paper as claimed in claim 4, wherein the molecular weight of the polyvinyl alcohol is 900 to 1,700.

6. A heat-sensitive recording paper as claimed in claim 1, wherein the polyvinyl alcohol is present in a coating amount of 2 to 4 g/m$^2$.

7. A heat-sensitive recording paper as claimed in claim 1, wherein the boric acid is present in an amount of 3 to 12 parts by weight per 100 parts by weight of the polyvinyl alcohol.

* * * * *